United States Patent [19]

Dearborn

[11] 4,344,411

[45] Aug. 17, 1982

[54] HEAT EXCHANGER FOR SPACE HEATERS

[76] Inventor: Howard K. Dearborn, 80 Portland St., Fryeburg, Me. 04037

[21] Appl. No.: 46,347

[22] Filed: Jun. 7, 1979

[51] Int. Cl.[3] ..... F24C 13/00; F28F 3/12

[52] U.S. Cl. ..... 126/34; 126/5; 165/168; 165/175

[58] Field of Search ..... 126/34, 53, 5, 365, 126/35, 72, 70, 83; 165/168, 172, 175, 170, 171

[56] References Cited

U.S. PATENT DOCUMENTS

| | | | |
|---|---|---|---|
| 357,874 | 2/1887 | Stirrat | 126/34 |
| 478,331 | 7/1892 | Joerden | 126/365 |
| 631,184 | 8/1899 | Sheppard | 126/34 |
| 777,083 | 12/1904 | Davis | 165/163 |
| 817,589 | 4/1906 | Roberts | 122/14 |
| 921,259 | 5/1909 | Kloeb | 126/116 R |
| 1,019,090 | 3/1912 | Ryerson | 122/20 R |
| 1,432,335 | 10/1922 | Howard | 126/34 |
| 1,440,810 | 1/1923 | Zacharias | 237/19 |
| 1,461,349 | 7/1923 | Hopfenthaler | 122/28 |
| 1,611,556 | 12/1926 | Puff | 126/34 |
| 1,615,960 | 2/1927 | Smith | 126/34 |
| 1,706,036 | 3/1929 | Nelsson | 122/20 B |
| 1,865,852 | 7/1932 | Goldhagen | 122/20 B |
| 1,884,612 | 10/1932 | Dinzl | 165/168 |
| 1,885,267 | 11/1932 | Kalfus | 122/20 B |
| 2,051,769 | 8/1936 | Keighley | 165/168 |
| 2,178,095 | 10/1939 | Bowser | 165/174 |
| 2,521,475 | 9/1950 | Nickolas | 165/168 |
| 3,896,992 | 7/1975 | Borovina | 237/19 |
| 3,951,129 | 4/1976 | Brantley | 126/441 |
| 3,958,755 | 5/1976 | Cleer | 237/8 R |
| 4,015,586 | 4/1977 | Vroom | 126/450 |
| 4,025,043 | 5/1977 | Cleer | 237/53 |
| 4,037,583 | 7/1977 | Bakun | 126/400 |
| 4,060,070 | 11/1977 | Harter | 165/171 |
| 4,154,210 | 5/1979 | Jaymes et al. | 126/34 |
| 4,195,617 | 4/1980 | Scopetti et al. | 126/5 |
| 4,200,086 | 4/1980 | Kolb | 126/77 |

OTHER PUBLICATIONS

Hydroheat System–Cleer, Jr.–Ridgway Steel, 3 pp.

E.C.E. Industries, Wisconsin Rapids, Wisconsin, publication re. Model 30D Gladiator.

Thermo–Control Wood Stoves, Cobleskill, N.Y., publication re. Water Heating Wood Stoves.

Hydroheat Division of Ridgway Steel, 1977, publication re. Wood Stove with Internal Heating.

All Nighter Stove Works, Glastonbury, Conn., publication re. Heating Stoves.

*Primary Examiner*—Daniel J. O'Connor

*Attorney, Agent, or Firm*—Fay & Sharpe

[57] ABSTRACT

A heat exchanger for use with a space heater having a combustion chamber wherein solid fuel, such as wood or coal, is supported for combustion. The heat exchanger comprises a metal plate having a plurality of spaced apart holes drilled therein extending perpendicular to the plate thickness and manifolds are attached to the plate in communication with the holes for circulating water therethrough. The plate is mounted on the space heater for heating the water circulated through the holes.

16 Claims, 10 Drawing Figures

HEAT EXCHANGER FOR SPACE HEATERS

BACKGROUND OF THE INVENTION

This application relates to the art of heat exchangers and, more particularly, to heat exchangers for use with space heaters which burn solid fuel such as wood or coal. Although the invention is particularly applicable to stoves which burn solid fuel and will be described with particular reference thereto, it will be appreciated that the invention has broader aspects and the heat exchanger can be used with space heaters such as fireplaces, and with space heaters which do not burn solid fuel.

Space heaters which burn solid fuel, such as wood or coal, have become very popular due to the shortage and high cost of natural gas, propane and fuel oil. Such space heaters, and particularly stoves, are finding high acceptance for residential and small commercial heating requirements. Although space heaters of this type are quite efficient and are easily capable of comfortably heating a large room in which they are installed, the heat is too often not uniformly distributed in the room, and is not readily distributed to other rooms. Many arrangements have been proposed for utilizing more of the heat output from such heat exchangers by heating remote areas or heating water, or both. However, previous arrangements of this type have been very complicated and expensive. In arrangements for circulating water through the space heater for heating the water and extracting heat therefrom at a remote location, coiled pipes and the like have been used for water circulation. Creosote and other combustion products form deposits on the pipe coils, and greatly reduce the heat transfer efficiency thereof. These deposits are very difficult to clean from round pipes. Furthermore, manufacture and assembly of coiled pipes and other similar radiators make such heat exchangers very expensive to manufacture and assemble. This is particularly true where the heat exchanger assembly requires a large number of individual pipes and joints which must be leak proof. Water circulating heat exchangers of this type are not usually suitable for installation in existing space heaters which were not build for that purpose.

It would be desirable to have a water circulating heat exchanger which could be installed in existing space heater structures or used in specially designed space heater structures, while being relatively inexpensive to manufacture and install.

SUMMARY OF THE INVENTION

A water circulating heat exchanger for use with space heaters includes a metal plate having substantially parallel opposite faces and an outer periphery. A plurality of spaced apart holes extend across the plate perpendicular to its thickness and parallel to its opposite faces, and manifold means is attached to the plate for circulating water through the holes. The plate is mountable on a space heater in heat exchange relationship therewith for heating water circulated through the plate holes.

In one arrangement, the holes are substantially parallel to one another and enter the plate at the plate outer periphery, and have hole inlet and outlet openings communicating with the manifold means. The opposite faces of the heat exchange plate are substantially flat and smooth for easy cleaning thereof with a flat bladed scraper or the like.

In one arrangement, the holes extend completely through the plate, and have hole entrance and exit ends which also define the hole inlet and outlet openings. The manifold means then comprises inlet and outlet manifolds attached to the plate in communication with the inlet and outlet openings.

In another arrangement, the holes enter the plate at entrance openings along one peripheral surface portion and extend toward an opposite peripheral surface portion. The holes terminate short of the opposite peripheral surface portion at blind hole ends which are connected with one another by connecting passages within the plate. The manifold means is attached to the plate in such a manner that a first plurality of the hole entrance openings define the hole inlet openings and a second plurality of the hole entrance openings define the hole outlet openings. Water then circulates through the plate by flowing through the inlet openings toward the blind hole ends of a first plurality of holes, then through the connecting passages and back through a second plurality of holes toward the outlet openings.

The plate may be generally rectangular to have substantially straight and parallel opposite ends, and substantially straight and parallel opposite sides. The plate may have flat parallel portions adjacent its opposite ends which are offset from one another and connected by an inclined plate portion.

The improved heat exchanger is preferably mounted on a space heater directly above a fire in the combustion chamber thereof for receiving heat by radiation, convection and conduction. The heat exchange plate may form the structural top of the space heater housing or may be mounted within the space heater.

Conduits connected with the manifold means may extend through the rear of the space heater housing. A flue opening in the space heater housing communicates with the combustion chamber, and the conduits connected with the manifold means may extend through the flue opening.

It is a principal object of the present invention to provide an improved liquid circulating heat exchanger for use with space heaters.

It is a further object of the invention to provide a liquid circulating heat exchanger which is very economical to manufacture and assemble in a space heater.

It is an additional object of the invention to provide an improved liquid circulating heat exchanger which can be fitted to existing space heater designs or can be incorporated in special space heater designs.

It is also an object of the invention to provide an improved space heater structure having an improved liquid circulating heat exchanger incorporated therein.

BRIEF DESCRIPTION OF THE DRAWINGS

The invention may take physical form in certain parts and arrangements of parts, preferred and alternative embodiments of which will be described in detail in this specification and illustrated in the accompanying drawings which form a part hereof and wherein.

DESCRIPTION OF PREFERRED EMBODIMENTS

Figure 1:
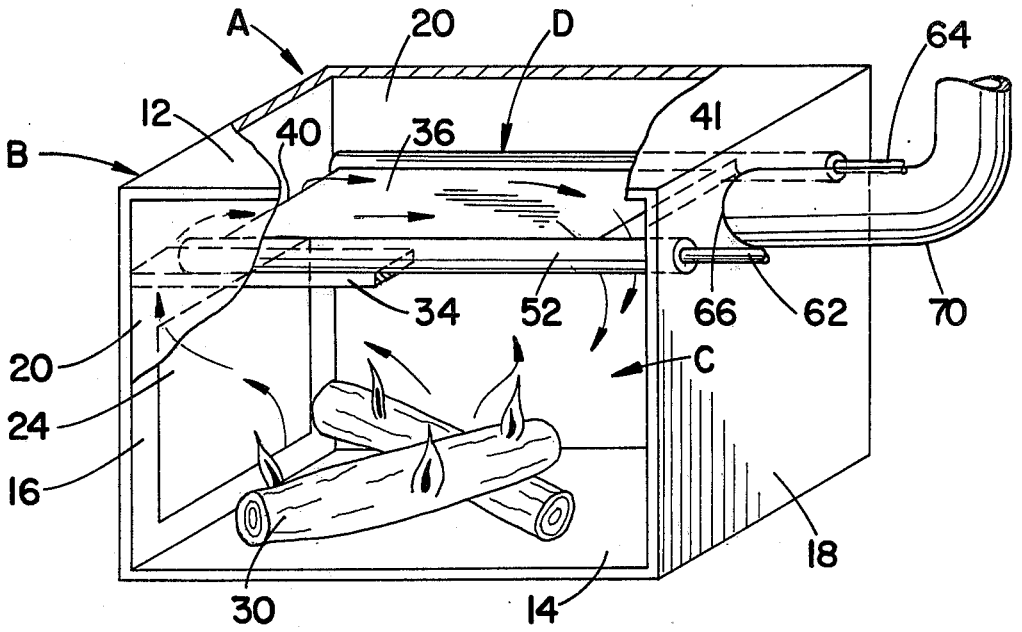
FIG. 1 is a schematic perspective illustration of a stove with a side wall thereof removed, and with a heat exchanger constructed in accordance with the present application incorporated therein.

With reference to the drawings, wherein the showings are for purposes of illustrating certain preferred embodiments of the invention only and not for purposes of limiting same, FIG. 1 shows a stove A including a housing B enclosing a combustion chamber C. Housing B is shown as including a top wall 12, a bottom wall 14, and a peripheral wall including front and rear walls 16,18 and opposite side walls 20.

Front wall 16 has a door 24 hinged therein in a known manner for providing access to combustion chamber C. Door 24 may have suitable adjustable openings therein for providing a flow of primary and secondary air into combustion chamber C. Solid fuel, such as wood or coal, is supported on the lower area of combustion chamber C for combustion therein. In the arrangement shown, wood logs are generally indicated at 30 as being supported on bottom wall 14. It will be recognized that a suitable grate may be positioned on bottom wall 14 for supporting either wood or coal raised above the bottom of combustion chamber C for better flow of air beneath and through the solid fuel. In addition, it will be recognized that housing B may be lined with fire brick and have other structural features commonly found on such stoves.

A liquid circulating heat exchanger D is mounted on stove A within combustion chamber C. In the arrangement shown, suitable support means is provided within housing B for supporting heat exchanger D therein. Opposite side supports may be provided within housing B suitably secured to the inside surfaces of the side walls thereof as by welding or the like. The top surfaces of a firebrick lining may also provide the support means. One side support is generally indicated at 34 in FIG. 1.

Figure 3:
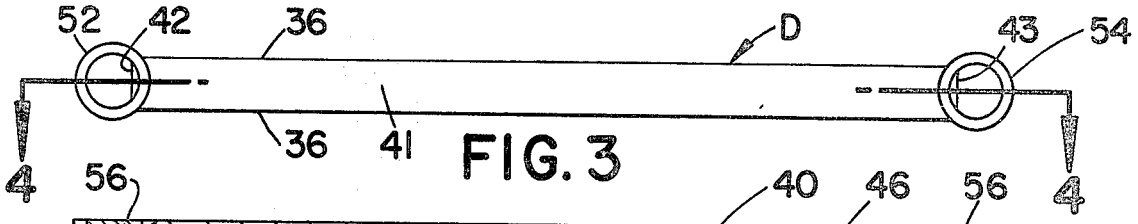
FIG. 3 is a rear elevational view of a heat exchanger used in the embodiment of FIG. 1.
Figure 4:
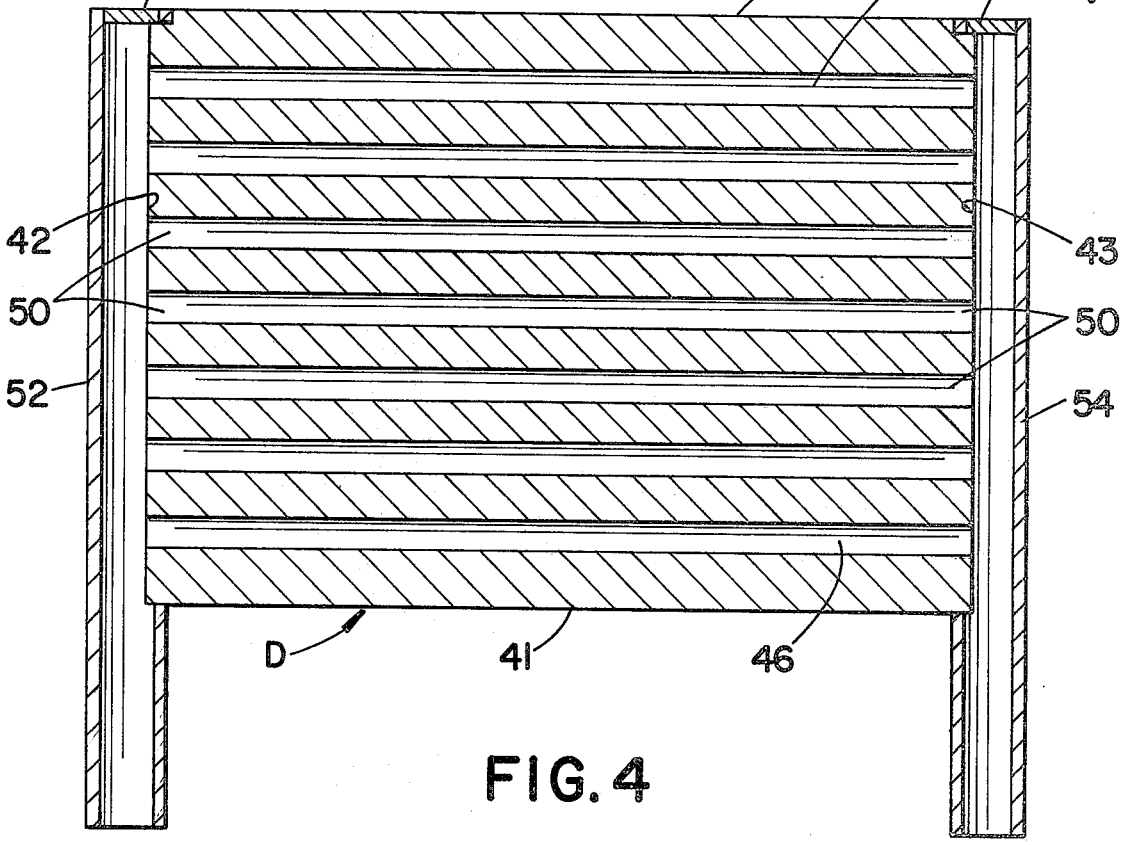
FIG. 4 is a cross-sectional elevational view taken generally on line 4—4 of FIG. 3.

With reference to FIGS. 3 and 4, heat exchanger D comprises a hot rolled descaled and deburred steel plate having substantially parallel opposite plane faces 36 and an outer periphery. The outer periphery of plate D is defined by substantially parallel straight opposite front and rear ends 40,41 defining a first pair of opposite peripheral portions, and substantially parallel straight opposite sides 42,43 defining a second pair of opposite peripheral portions. A plurality of spaced-apart holes 46 extend across plate D in a direction perpendicular to the thickness thereof. In the arrangement shown, holes 46 extend completely through plate D across opposite sides 42,43. Holes 46 are spaced-apart in a direction parallel to opposite faces 36 and across ends 40,41, and are substantially parallel to one another. ,p Opposite hole entrance and exit openings 50 also define the hole inlet and outlet openings. Manifold means in the form of inlet and outlet manifolds 52 and 54 are attached to opposite plate sides 42,43 as by welding, and communicate with hole inlet and outlet openings 50. Water supplied to one manifold 52 under pressure will circulate therethrough and through hole ends 50, then completely across plate D to the opposite side thereof and out manifold 54.

Cylindrical holes 46 are drilled through plate D, and the unitary nature of plate D provides uniform heating thereof. Manifolds 52,54 may take many forms, and in the arrangement shown are simply pipes having plugs 56 welded over one end. Longitudinal slits are formed in the pipes from the plugged ends thereof toward the other ends thereof over a length approximately the same as the length of plate sides 42,43. The slits have a width approximately the same as the thickness of plate D. The pipes and plate are assembled by positioning plate sides 42,43 within the pipe slits and welding along all joining surfaces.

Plate D may be mounted as shown in FIG. 1 in downwardly-spaced relationship to housing top wall 12 within combustion chamber C. Front and rear ends 40,41 are preferably spaced somewhat from front and rear walls 16,18 of housing B. Manifolds 52 and 54 extend through suitable packing glands mounted in suitable holes in housing rear wall 18, and are connected with pipes 62,64 for circulation of water through the holes in plate D. With plate D positioned as shown in FIG. 1, heat is transferred thereto by convection, conduction and radiation from combustion of solid fuel within combustion chamber C. Rear wall 18 has a flue opening 66 to which a stove pipe 70 is connected for exhausting combustion products from combustion chamber C. The combustion products flow across both opposite faces of plate D for transferring heat thereto and this also forms deposits thereon. Due to the fact that plate D has smooth and flat opposite faces, it is very easy to clean same with a flat bladed scraper. The one face which faces directly toward combustion chamber C can be scraped by reaching into the combustion chamber through door 24. For extremely thorough cleaning, it is possible to remove top wall 12 of stove A or to remove plate D therefrom by disconnecting pipes 62,64. It is possible to dimension plate D so it can be positioned within housing B and removed therefrom through door 24.

Figure 2:
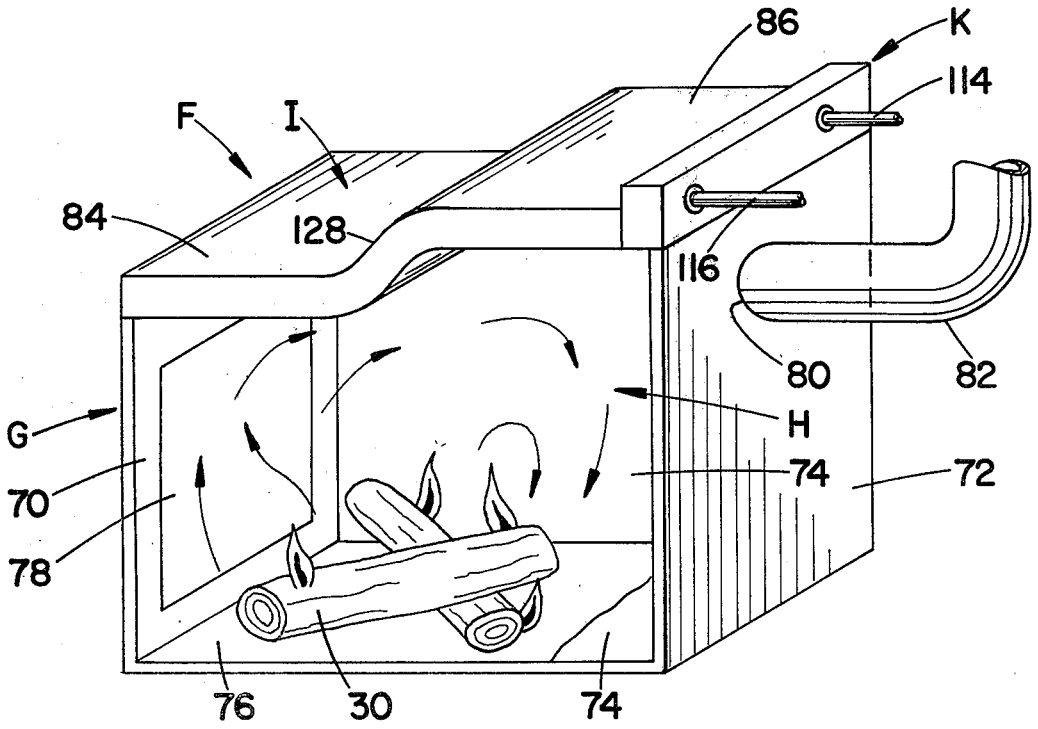
FIG. 2 is a perspective illustration similar to FIG. 1 and showing another embodiment.

FIG. 2 shows a stove F including a housing G enclosing a combustion chamber H. Housing G includes front and rear walls 70,72 and opposite side walls 74. A bottom wall 76 defines the bottom area of combustion chamber H. A hinged access door 78 is provided in front wall 70 to provide access to combustion chamber H. Suitable adjustable openings in door 78 provide selective flow of primary and secondary air to combustion chamber H. A flue opening 80 in rear wall 72 communicates with combustion chamber H for venting combustion products through a stove pipe 82. The top wall of housing G is defined by a heat exchanger I which is a structural part of the housing itself. Although heat exchanger I can be completely flat across its entire length, FIG. 2 shows the stove as being of the type having a front end which is lower than the rear end. Thus, heat exchange plate I includes a first flat portion 84 adjacent the front of stove F and a second flat portion 86 adjacent to the rear of stove F. Flat portions 84 and 86 extend parallel to one another and are vertically offset so that flat portion 86 is at a higher horizontal elevation than flat portion 84. Both flat portions 84 and 86 extend substantially horizontally.

Figure 6:
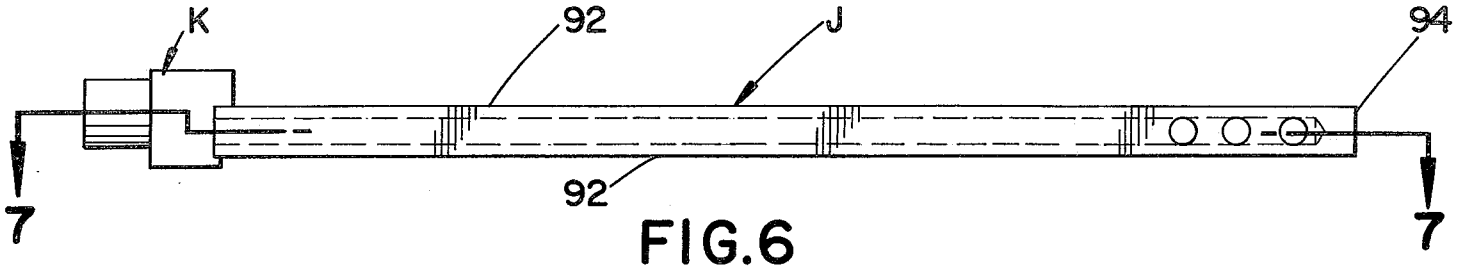
FIG. 6 is a side elevational view of a heat exchanger used in the embodiments of FIGS. 2 and 5.
Figure 7:
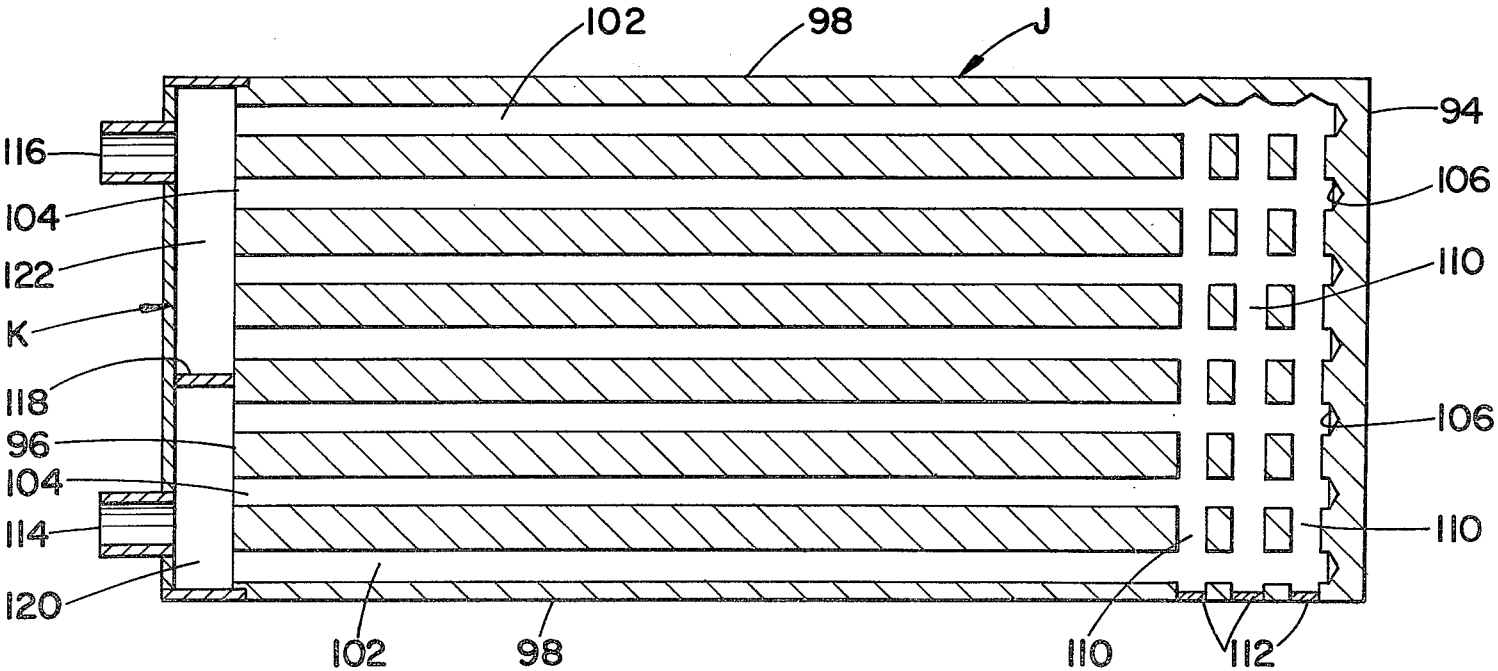
FIG. 7 is a partial cross-sectional elevational view taken generally on line 7—7 of FIG. 6.

Heat exchanger I is formed from a flat metal plate J as shown in FIGS. 6 and 7. Plate J has opposite flat outer faces 92, parallel opposite front and rear ends 94,96, and parallel opposite sides 98. A plurality of spaced-apart parallel holes 102 are formed in plate J extending perpendicular to the thickness of the plate and parallel to opposite faces 92. Holes 102 have entrance openings 104 spaced along plate rear end 96, and extend across plate J toward front end 94 to terminate short thereof at blind hole ends 106. Transverse hole means defined by connecting passages 110 are formed in plate J to connect holes 102 adjacent blind ends 106 thereof. The holes bored in plate J to form transverse connecting passages 110 have their entrance openings welded closed as indicated at 112.

Manifold means in the form of a manifold K is welded to end 96 in communication with hole openings 104. Inlet and outlet conduits 114,116 are secured to manifold means K. An internal partition 118 divides manifold means K into inlet and outlet manifolds 120,122. Inlet manifold 120 communicates with a first plurality of entrance openings 104 which define inlet openings to holes 102. Outlet manifolds 122 communicates with a second plurality of entrance openings 104 which define the hole outlet openings. Outlet manifolds 122 communicates with a second plurality of entrance openings 104 which define the hole outlet openings. Water is circulated through inlet conduit 114, inlet manifold 120, inlet openings 104, through holes 102 toward blind hole ends 106, through connecting passages 110, back along different holes 102 toward outlet openings 104 communicating with outlet manifold 122, and then out through outlet conduit 116.

Heat exchanger plate J is first manufactured to the construction described with reference to FIGS. 6 and 7, and is then bent intermediate its opposite ends 94,96 in order to vertically offset flat portions 84,86 of FIG. 2 which are connected by an inclined flat plate portion 128. Sloping portion 128 slopes upwardly from flat plate portion 84 in a direction from the front to the rear of stove F. Heat exchange plate I of FIG. 2 is suitably welded or bolted to the top of stove F. The underside of plate I which faces toward combustion chamber H can be scraped clean by reaching through door 78.

Figure 5:
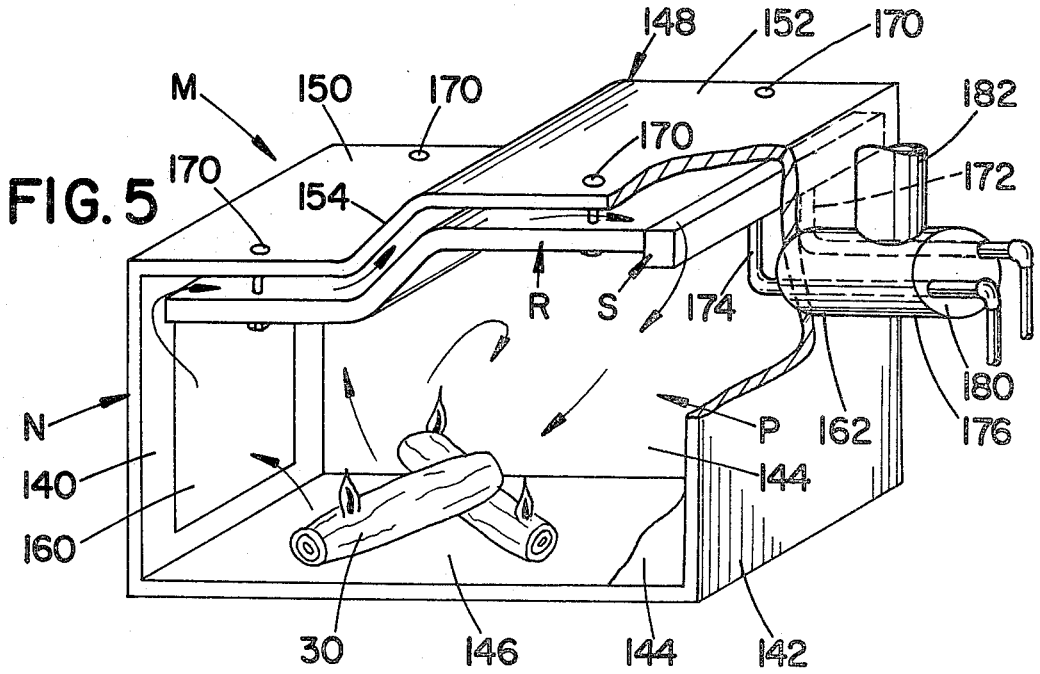
FIG. 5 is a schematic perspective illustration similar to FIGS. 1 and 2, and showing another embodiment.

FIG. 5 shows another arrangement wherein a stove M includes a housing N enclosing a combustion chamber P. Housing N includes front and rear walls 140,142 and opposite side walls 144. A bottom wall 146 forms the lower area of combustion chamber P. A top wall 148 is stepped to provide a lower horizontal portion 150 adjacent the front of stove M and a higher horizontal portion 152 adjacent the rear of stove M. The top wall portions 150,152 are connected by an inclined portion 154. A suitable access door 160 is provided in housing front wall 140 and a flue opening 162 in rear wall 142 provides an exhaust opening for combustion products from a combustion chamber P. A heat exchanger plate R is constructed in the same manner as described with respect to FIGS. 6 and 7, and heat exchange plate I of FIG. 2. However, heat exchange plate R is suspended within housing N in downwardly spaced relationship to housing top wall 148 as by bolts 170 passing through suitable holes in top wall 148 and heat exchange plate R. The holes through heat exchange plate R are formed in areas of the plate not occupied by water circulating holes and nuts are threaded on the bolts beneath plate R. Heat exchange plate R is shaped in the same manner as plate I, and is also shaped to extend parallel to stove top wall 148. A manifold S on the rear end of heat exchange plate R corresponds generally to manifold K on plate I. Conduits 172,174 connected with manifold F extend through flue openings 162 and through a horizontal section 176 of a stove pipe. An end plate 180 on stove pipe section 176 has suitable packing glands through which conduits 172,174 extend. A stove pipe 182 is connected to stove pipe section 176 for exhausting combustion products from combustion chamber P.

It will be recognized that plates D and J may be of any suitable dimensions depending upon the stove with which the plate will be used and upon the amount of heat to be exchanged. Working models have been constructed using plates having a thickness of approximately $\frac{5}{8}$ inch. Holes 46 and 102 have had a diameter of approximately $\frac{3}{8}$ inch, and have been centered between the opposite faces of the plates and spaced on one inch centers. In the model, plate J of FIGS. 6 and 7 had a length of approximately 42 inches and a width of approximately 20 inches. A working model using a plate similar to plate D has a length of approximately 18 inches and a width of approximately 12 inches. It will be recognized that these dimensions are given by way of example only and should not be taken in a limiting sense. However, the diameter and spacing of the holes has been found to be a highly efficient arrangement. The arrangement shown and described using a one-piece flat plate provides very uniform heat transfer to liquid flowing through all of the holes and also provides an arrangement in which products of combustion deposited on the plate surfaces can be scraped off.

Figure 8:
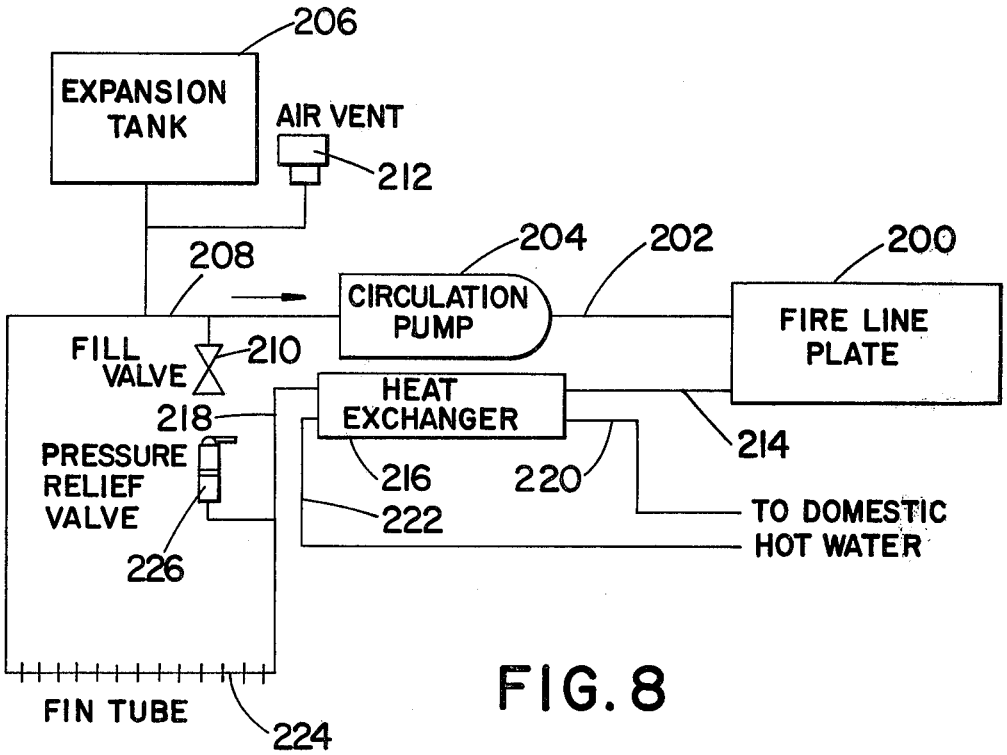
FIG. 8 is a diagrammatic illustration of a liquid circulating arrangement using the heat exchanger of the present application.

FIG. 8 simply shows an example of a water circulating system using the improved plate heat exchanger of the present application. Plate 200, constructed in accordance with the features in FIGS. 3, 4, 6 and 7 of the present application, is connected by conduit 202 with a pump 204 supplied with water from an expansion tank 206 through conduit 208 having a fill valve 210. A suitable air vent 212 is connected with conduit 208 and expansion tank 206. Outlet conduit 214 from heat exchange plate 200 leads to a heat exchanger 216 which may simply be a closed tank filled with water. Conduit 214 may extend in a tortuous or coiled path through heat exchanger 216 and exit at 218. Another conduit 220 extends in a coiled path through heat exchanger 216 and exits at 222 for connection with a domestic hot water heater or the like. Thus, the water heated in heat exchange plate 200 transfers heat to the water in heat exchanger 216 which in turn transfers heat to water used in the domestic water heater. A fin tube radiator 224 or the like may also be connected with conduit 218 and be positioned in a room or other area remote from the stove on which heat exchange plate 200 is installed. A suitable pressure relief valve 226 is connected with conduit 218 for relieving pressure.

Figure 9:
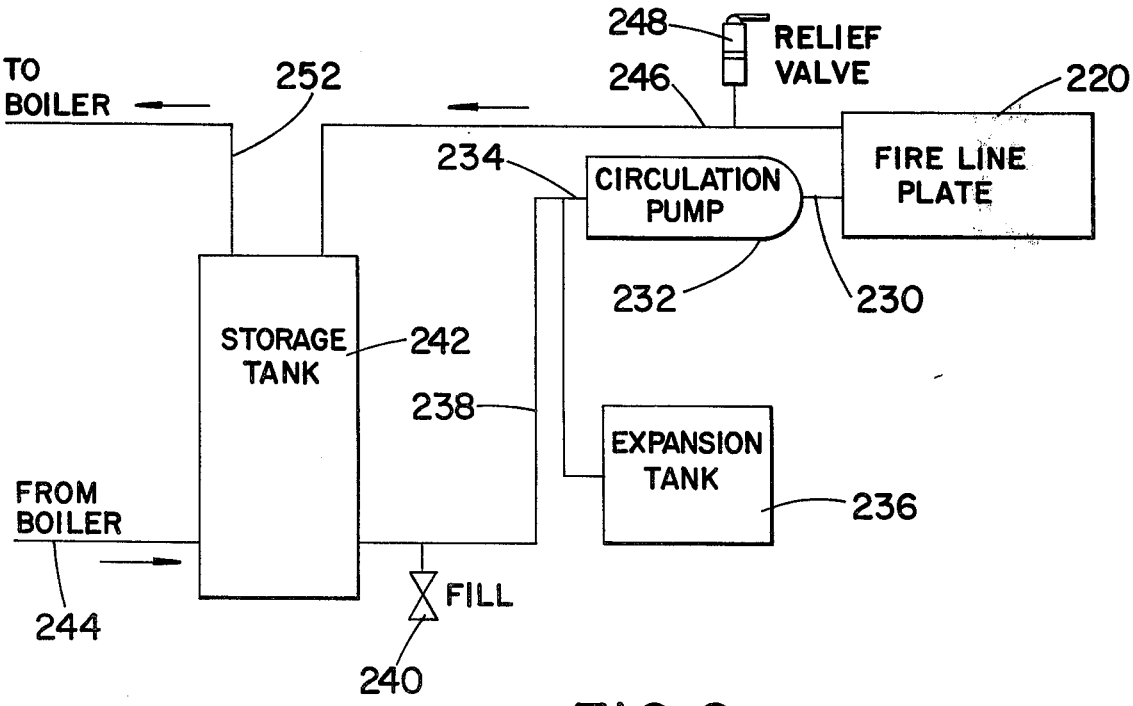
FIG. 9 is a diagrammatic illustration of another liquid circulating arrangement; and, FIG. 10 is a diagrammatic illustration of still another liquid circulating arrangement.

FIG. 9 shows another arrangement wherein flat plate heat exchanger 220 constructed in accordance with the present application is supplied through a conduit 230 by pump 232 connected by conduit 234 with expansion tank 236. A conduit 238 has a fill valve 240, and is connected with pump 232 and a storage tank 242. A conduit 244 extends into storage tank 242 from a furnace boiler or the like. Outlet conduit 246 from heat exchange plate 220 has a relief valve 248 therein and is connected with hot water storage tank 242 which has an outlet conduit 252 connected therewith for supplying heated water to the boiler.

Figure 10:
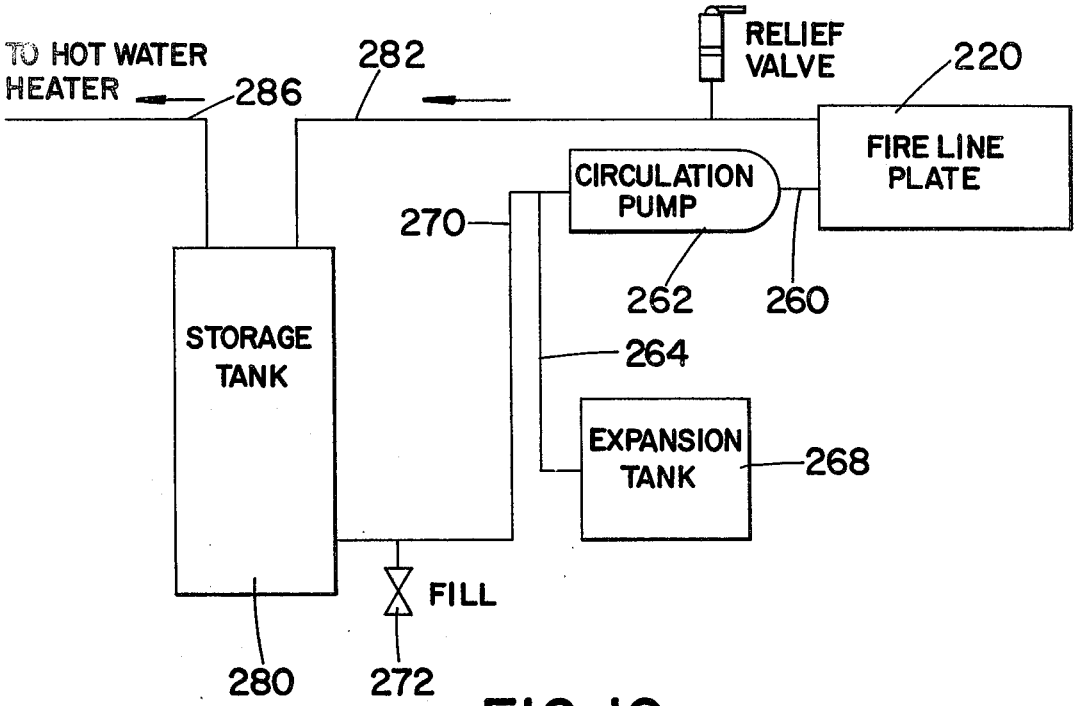

FIG. 10 shows another arrangement similar to FIG. 9 wherein heat exchange plate 220 is connected by conduit 260 with circulation pump 262 connected by conduit 264 with expansion tank 268. Another conduit 270 is connected with pump 262 and has a fill valve 272 therein. Conduit 270 is connected with storage tank 280 which is also connected by outlet conduit 282 from flat plate heat exchanger 220. Outlet conduit 286 from storage tank 280 leads to a domestic hot water heater.

Although the preferred arrangements have been shown and described with respect to space heaters in the form of stoves of the type having housings enclosing a combustion chamber, it will be recognized that the heat exchanger of the present application can be used with built-in or free standing fireplaces, as well as with other types of space heaters. The water circulating holes are drilled in the plate, and in the arrangement of FIGS. 6 and 7, the holes have drill entrance ends or openings 104. Some of these hole entrance openings define hole inlet openings for water circulation, while other hole entrance openings define hole outlet openings for water circulation. In the arrangement of FIGS. 3 and 4, the holes have both drill entrance and exit openings, and these provide the water circulating hole inlet and outlet openings. The plate heat exchanger has means for assembling same in cooperative heat exchange relationship with a solid fuel burning stove, and this means may simply be the plate shape or other special assembly structure.

Although the invention has been shown and described with respect to certain preferred and alternative embodiments, it is obvious that modifications and alterations will occur to others upon the reading and understanding of this specification. It is my intention to include all such modifications and alterations infoar as they come within the scope of the appended claim or the equivalents thereof.

Having thus described the invention it is now claimed:

1. A heat exchanger for fuel burning heating stoves comprising: a plate having substantially parallel opposite faces and an outer periphery, a plurality of individual spaced-apart substantially parallel elongated holes entering said plate at said outer periphery and extending between said opposite faces substantially parallel thereto, said holes being spaced-apart in a direction extending substantially parallel to said faces, said holes being of substantially the same diameter and being spaced-apart substantially equidistantly, said plate having a thickness not greater than two times the diameter of one said hole, said holes being spaced from one another such that the plate material between adjacent holes has a width at least as great as the diameter of one said hole and not greater than approximately two times the diameter of one said hole, inlet and outlet openings for said holes, manifold means attached to said plate for circulation of liquid through said holes between said inlet and outlet openings, said plate being mountable to structure defining at least part of a solid fuel burning space heater in heat exchange relationship with the heat produced by combustion of such fuel therein for heating liquid circulating through said holes between said inlet and outlet openings, and said plate having reduced areas at each end relative to said manifold means whereby upon installation combustion products may circulate about said reduced areas.

2. The heat exchanger as defined in claim 1 wherein said opposite faces are substantially flat.

3. The heat exchanger as defined in claim 1 wherein said plate outer periphery is defined by first and second pairs of substantially parallel opposite plate peripheral surfaces.

4. The heat exchanger as defined in claim 3 wherein said holes extend completely through said plate across one of said pair of opposite plate peripheral surfaces and have hole entrance and exit ends defining said inlet and outlet openings, and said manifold means comprises inlet and outlet manifolds attached to said plate along said one pair of opposite plate peripheral surfaces.

5. The heat exchanger as defined in claim 3 wherein said holes enter said plate at entrance openings along one said peripheral surface and extend toward an opposite peripheral surface and terminate short thereof at blind hole ends, said blind hole ends being connected with one another, said manifold means being attached to said plate along said one peripheral surface such that a first plurality of said entrance openings define said inlet openings and a second plurality of said entrance openings define said outlet openings so that water circulates through said plate by flowing through said inlet openings to said blind hole ends and then from said blind hole ends to said outlet openings.

6. The heat exchanger as defined in claim 1 wherein said plate has opposite peripheral surface portions across which said holes extend, said plate being bent intermediate said opposite peripheral surface portions to define opposite substantially parallel flat plate portions connected by an inclined plate portion.

7. The heat exchanger as defined in claim 6 wherein said holes have entrance openings along one of said opposite peripheral surface portions and terminate short of the opposite peripheral surface portion at blind hole ends, transverse hole means for connecting said holes adjacent said blind hole ends, said manifold means being attached to said plate along said one peripheral surface portion and including inlet and outlet manifolds, said inlet manifold communicating with a first plurality of said entrance openings which form said inlet openings, and said outlet manifold communicating with a second plurality of said entrance openings which form said outlet openings.

8. The heat exchanger as defined in claim 1 wherein said plate has a thickness of approximately $\frac{5}{64}$ inch, said holes having a diameter of approximately $\frac{3}{32}$ inch and being spaced on approximately one inch centers.

9. The heat exchanger as defined in claim 1 wherein said plate is mountable within a stove directly above a fire therein for receiving heat by radiation, convection and conduction.

10. The heat exchanger as defined in claim 1 wherein said plate is mountable as the structural top of a stove.

11. A heat exchanger for fuel burning heating stoves and the like comprising: a metal plate having substantially parallel opposite faces, front and rear ends defining a first pair of opposite peripheral portions, and opposite sides defining a second pair of opposite peripheral portions, a plurality of individual spaced-apart elongated holes extending across said plate between one said pair of opposite peripheral portions intermediate said opposite faces, said holes being spaced-apart along said plate between the other said pair of opposite peripheral portions, said holes being of substantially the same diameter and being spaced-apart substantially equidistantly, said plate having a thickness not greater than two times the diameter of one said hole, said holes being spaced from one another such that the plate material between adjacent holes has a width at least as great as the diameter of one said hole and not greater than approximately two times the diameter of one said hole, said plate having inlet and outlet openings communicating with said holes, manifold means attached to said plate for circulation of liquid through said holes between said inlet and outlet openings, and said plate being mountable to structure defining at least part of a solid fuel burning heating stove in heat transfer relationship with the heat produced by combustion of such fuel therein for heating liquid circulated through said holes, and said plate having reduced areas at each end relative to said manifold means whereby upon installation combustion products may circulate about said reduced areas.

12. The heat exchanger as defined in claim 11 wherein said holes extend completely through said plate and have hole entrance and exit openings along said one pair of opposite peripheral portions to define said inlet and outlet openings, and said manifold means comprising inlet and outlet manifolds attached to said plate along said one pair of opposite peripheral portions.

13. The heat exchanger as defined in claim 11 wherein said holes have opposite hole ends and said plate is bent between said one pair of opposite peripheral portions so that said holes extend along other than straight lines between said hole ends.

14. The heat exchanger as defined in claim 11 wherein said plate has substantially parallel flat plate portions at different elevations adjacent said one pair of opposite peripheral portions and has an inclined plate portion connecting said flat plate portion.

15. The heat exchanger as defined in claim 11 wherein said holes open outwardly of said plate at hole openings adjacent only one peripheral portion of said one pair of peripheral portions and have blind hole ends adjacent the other peripheral portion of said one pair of peripheral portions, connecting passages in said plate connecting said holes adjacent said blind hole ends, said manifold means comprising an inlet manifold attached to said plate adjacent said one peripheral portion in communication with a first plurality of said hole openings defining said inlet openings and an outlet manifold attached to said plate adjacent said one peripheral portion in communication with a second plurality of said hole openings defining said outlet openings, whereby liquid is circulated from said inlet manifold through said inlet openings toward said blind hole ends and then through said connecting passages to said outlet openings and said outlet manifold.

16. The heat exchanger as defined in claim 15 wherein said plate has substantially parallel flat portions adjacent said one pair of opposite peripheral portions, said flat portions being offset from one another and connected by an inclined plate portion.

* * * * *